US008485346B2

(12) United States Patent
Redick et al.

(10) Patent No.: US 8,485,346 B2
(45) Date of Patent: Jul. 16, 2013

(54) CHECKSTAND

(75) Inventors: Dave Redick, Butler, PA (US); Jan Hawkins, Mars, PA (US); Patty Pataky, North Huntingdon, PA (US); Jeffrey T. Hassman, Canton, GA (US); Eric J. Kaplan, Smyrna, GA (US); Adam Price, Anderson, SC (US)

(73) Assignee: Phoenix Intangibles Holding Company, Greenville, DE (US)

( * ) Notice: Subject to any disclaimer, the term of this patent is extended or adjusted under 35 U.S.C. 154(b) by 155 days.

(21) Appl. No.: 13/008,450

(22) Filed: Jan. 18, 2011

(65) Prior Publication Data

US 2011/0174594 A1 Jul. 21, 2011

Related U.S. Application Data

(60) Provisional application No. 61/295,919, filed on Jan. 18, 2010.

(51) Int. Cl.
*B65G 47/44* (2006.01)

(52) U.S. Cl.
USPC ..... 198/550.5; 186/67

(58) Field of Classification Search
USPC ..... 198/571, 572, 576, 542, 550.5; 186/63, 186/67, 68, 69; 312/317.1, 319.5
See application file for complete search history.

(56) References Cited

U.S. PATENT DOCUMENTS

| | | | | |
|---|---|---|---|---|
| 2,599,909 | A | 6/1952 | George | |
| 2,631,689 | A | 3/1953 | Rubaloff | |
| 2,871,984 | A | 2/1959 | Colman | |
| 2,902,115 | A | 9/1959 | McNeil et al. | |
| 3,075,616 | A * | 1/1963 | Shofiner | 186/66 |
| 3,090,467 | A | 5/1963 | Crawford | |
| 3,126,981 | A | 3/1964 | Crawford | |
| 3,960,420 | A | 6/1976 | Speraw | |
| 3,990,540 | A | 11/1976 | Aleshire | |
| 4,236,604 | A * | 12/1980 | Warner | 198/810.01 |
| 4,265,335 | A | 5/1981 | Joseloff | |
| 4,330,048 | A * | 5/1982 | Joseloff | 186/66 |
| 4,512,540 | A | 4/1985 | Stroh | |
| 5,706,912 | A | 1/1998 | Holland | |

* cited by examiner

*Primary Examiner* — James R Bidwell
(74) *Attorney, Agent, or Firm* — Eckert Seamans Cherin & Mellott, LLC; Stephen A. Bucchianeri

(57) ABSTRACT

A checkstand includes a cabinet, an electrically actuated conveyor, and an electrically actuated rotatable turntable. The electrically actuated conveyor is mounted on a portion of the cabinet. The conveyor is structured to convey items from a first end to an opposite second end when actuated. The electrically actuated rotatable turntable is mounted on the cabinet proximate the second end of the conveyor. The turntable is structured to receive items from the conveyor.

14 Claims, 8 Drawing Sheets

CHECKSTAND

CLAIM TO PRIORITY

This application claims priority to U.S. provisional application No. 61/295,919 filed Jan. 18, 2010, entitled "Checkstand", the contents of which are incorporated herein by reference.

BACKGROUND OF THE INVENTION

1. Field of the Invention

The present invention pertains to checkstands, and, more particularly, to checkstands having a conveyor and turntable. The present invention further pertains to conveyance systems for a checkstand and methods of operating a checkstand.

2. Description of the Related Art

In many grocery stores it is customary for the customers to select their grocery items and then transport them via a shopping cart or other suitable mechanism to a checking-out point, commonly referred to as a "checkstand". At such checkstand, a checker or cashier, checks and tallies the items purchased and then determines the total sales price to be paid. Such method of merchandising is also employed in other types of retail stores, such as drug, hardware, gardening, feed, and other similar stores. From a competitive viewpoint, it is highly desirable to perform the checking-out operation rapidly, accurately, and with a minimum of expense.

In conventional checkstands, conveyor belt means are typically employed to feed a succession of items to be checked from an unloading position to a bagging position. The checking is typically done by a cashier at a checking position which is typically situated at a location intermediate the unloading and bagging positions. The customer, or in some cases the checker or cashier, removes the selected items from the shopping cart and places them on the conveyor belt means, which transports the items to the checking position. In such conventional checkstands, the conveyor belt means delivers and unloads the items onto a stationary platform that is generally equipped with an electronic scanning device for scanning each item. This type of unloading often leads to congestion of the items at the end of the conveyor belt means with consequent tumbling of the items so unloaded and possible breakage of the glass-enclosed articles. Such congestion leads to unwarranted delays in the subsequent bagging of items and checking of subsequent customers. Such delays in servicing many customers throughout a day's operation represents a deficiency which has heretofore been accepted as unavoidable.

Although conventional checkstands have been generally suitable for their intended uses, there is still room for improvement in checkstands, particularly in their arrangement and the mechanisms used thereon for conveying items.

SUMMARY OF THE INVENTION

Accordingly, it is an object of the present invention to provide a checkstand for checking customers from a retail establishment or similar store that overcomes the shortcomings of conventional checkstands. This object is achieved according to one embodiment of the present invention by providing a checkstand. The checkstand comprises a cabinet having an electrically actuated conveyor mounted on a portion of the cabinet. The conveyor is structured to convey items from a first end to an opposite second end when actuated. The checkstand further comprises an electrically actuated rotatable turntable mounted on the cabinet proximate the second end of the conveyor. The turntable is structured to receive items from the conveyor.

The cabinet may comprise a number of sensors disposed therein. At least one of the number of sensors may be structured to detect the presence of one or more items on the conveyor and, in response thereto, actuate the conveyor. At least one of the number of sensors may be structured to detect the presence of one or more items at a particular location on the turntable and, in response thereto, actuate the turntable. At least one of the number of sensors may be structured to detect the presence of one or more items at a particular location on the turntable and, in response thereto, cease actuation of the turntable. At least one of the number of sensors may be structured to detect the presence of a separator member on the conveyor proximate the second end of the conveyor and, responsive thereto, cease actuation of the conveyor. The separator member may comprise a magnetic material and at least one of the number of sensors may comprise a magnetic sensor.

This object is achieved according to another embodiment of the present invention by providing a conveyance system for use with a checkstand. The conveyance system comprises an electrically actuated conveyor structured to be mounted on a portion of the checkstand. The conveyor is structured to convey items from a first end to an opposite second end when actuated. The conveyance system further comprises an electrically actuated rotatable turntable structured to be mounted on the checkstand proximate the second end of the conveyor. The turntable is structured to receive items from the conveyor.

The conveyor may comprise a number of sensors associated therewith, at least one of the number of sensors being structured to detect the presence of one or more items on the conveyor and, in response thereto, actuate the conveyor. The turntable may comprise a number of sensors associated therewith, at least one of the number of sensors being structured to detect the presence of one or more items at a particular location on the turntable and, in response thereto, actuate the turntable. Similarly, the turntable comprises a number of sensors, at least one of the number of sensors being structured to detect the presence of one or more items at a particular location on the turntable and, in response thereto, cease actuation of the turntable. The conveyor may comprise a number of sensors disposed therewith, at least one of the number of sensors being structured to detect the presence of a separator member on the conveyor proximate the second end of the conveyor and, responsive thereto, cease actuation of the conveyor. The separator member may comprise a magnetic material and at least one of the number of sensors may comprise a magnetic sensor.

This object is achieved according to yet another embodiment of the present invention by providing a method of operating a checkstand. The method comprises receiving a first number of items from a first customer on a conveyor, transporting the first number of items along the conveyor and transferring the first number of items from the conveyor to a rotating surface.

The method may further comprise selectively choosing selected items from the rotating surface and placing the selected items in a shopping bag. Selectively choosing items from the rotatable surface may comprise scanning the selected items to determine a price before placing the items in a shopping bag. The items may be selected according to a predetermined criteria. The method may further comprise receiving a second number items from a second customer on the conveyor while selectively choosing selected items from the rotatable surface. The method may also further comprise providing a separator member for placement on the conveyor between the first number of items and the second number of items, transporting at least a portion of the first number of items and the second number of items along the conveyor, sensing the position of the separator member at a location on the conveyor near the rotatable surface, and stopping movement of the conveyor in response to sensing the position of the separator member.

BRIEF DESCRIPTION OF THE DRAWINGS

A full understanding of the invention can be gained from the following description of the preferred embodiments when read in conjunction with the accompanying drawings in which.

Figure 1:
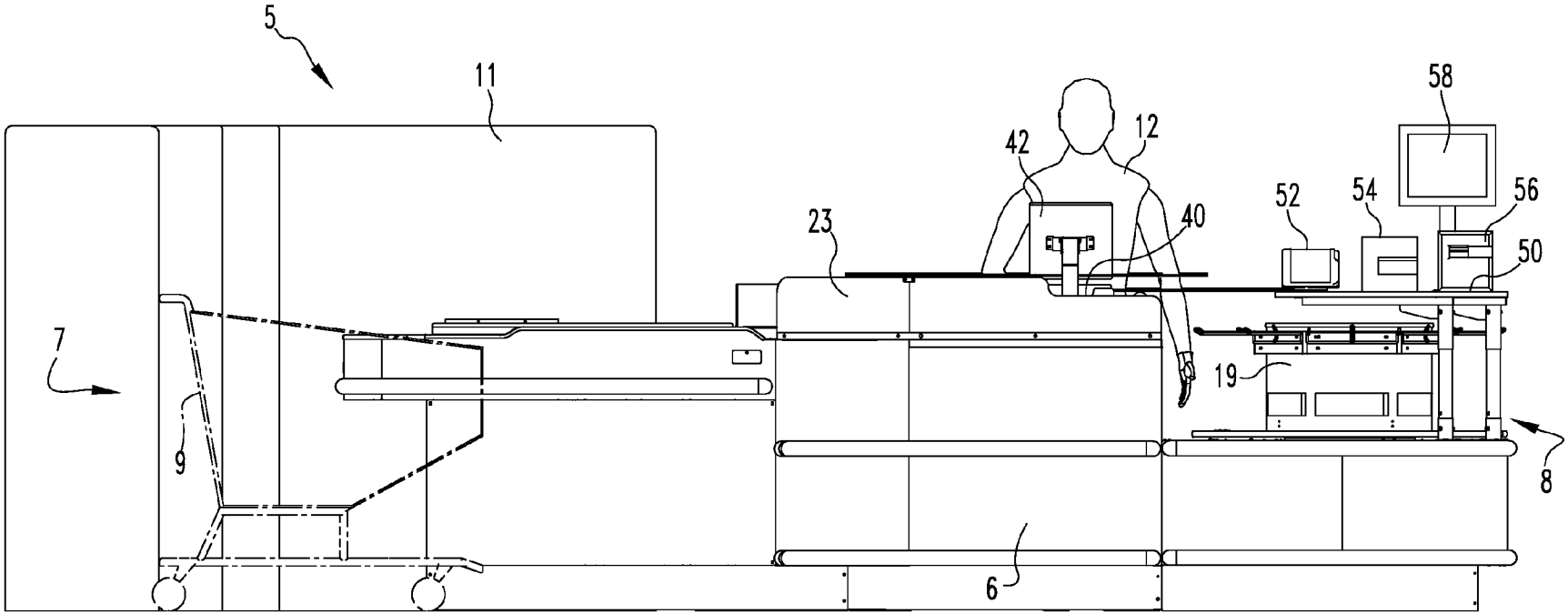
FIG. 1 shows a front elevational view of a checkstand in accordance with an embodiment of the invention.

It is to be appreciated that the figures described above are provided to increase understanding of the present invention and are not meant to limit the invention.

DESCRIPTION OF THE PREFERRED EMBODIMENTS

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality). As employed herein, the term "and/or" shall mean both alternatives (i.e., "and") or just one of the alternatives (i.e., "or").

Directional phrases used herein, such as, for example and without limitation, top, bottom, left, right, upper, lower, front, back, and derivatives thereof, relate to the orientation of the elements shown in the drawings and are not limiting upon the claims unless expressly recited therein. Like numbers refer to like elements throughout.

FIGS. 1-7 show an example checkstand 5 in accordance with a non-limiting embodiment of the present invention. Checkstand 5 may commonly be employed, for example, without limitation, in "checking" customers from a store, such as a grocery or other retail establishment. During such "checking" process, items selected from the store by the customer are typically scanned to determine the price of the items, which is then totaled to determine a bill for the customer. Once scanned, items are typically placed either directly into shopping bags or alternatively onto another surface for subsequent bagging.

Similar to conventional checkstands, checkstand 5 is generally formed from one or more housings or cabinet members 6 preferably formed from wood, composite, metal or other suitable material or combination of materials and generally includes a first end 7, which is typically oriented toward the sales floor portion of a retail establishment, and a second end 8, which is typically disposed away from the sales floor portion and toward the entrance/exit of a retail establishment. Accordingly, a customer (not shown) looking to pay for a number of items that have been selected from the sales floor and stored, temporarily, in a shopping cart 9 or other suitable mechanism would first approach the first end 7 of checkstand 5 as shown generally in FIG. 1. After completing the checking process, the customer would then exit the checkstand 5 moving generally away from second end 8. A shelf portion or other suitable retail display member 11 (FIG. 1) may be provided generally proximate first end 7 on which retail items may be provided for customer viewing and selection while waiting, and during, checkout.

Figure 2:
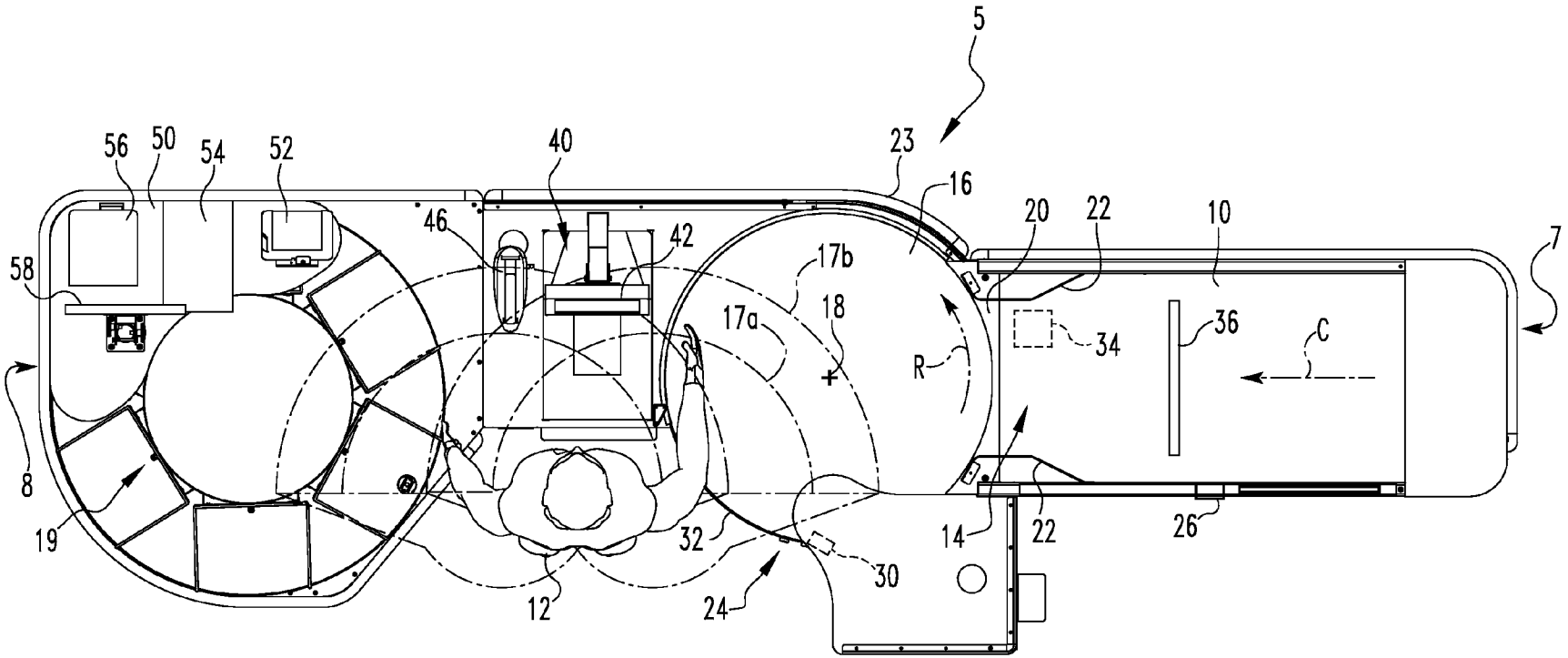
FIG. 2 shows a top plan view of the checkstand of FIG. 1.
Figure 5:
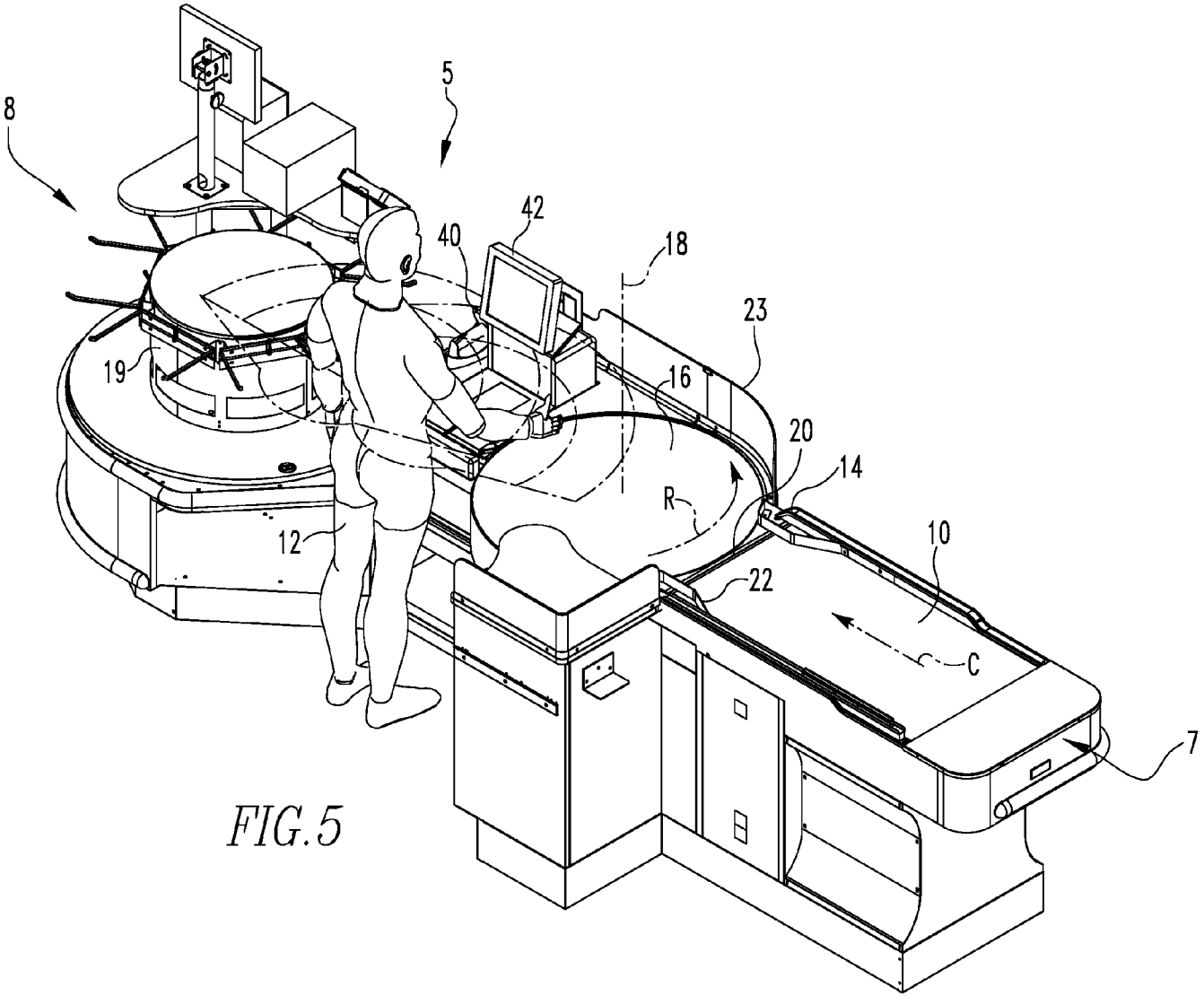
FIG. 5 shows an isometric view of the rear of the checkstand of FIG. 1.
Figure 6:
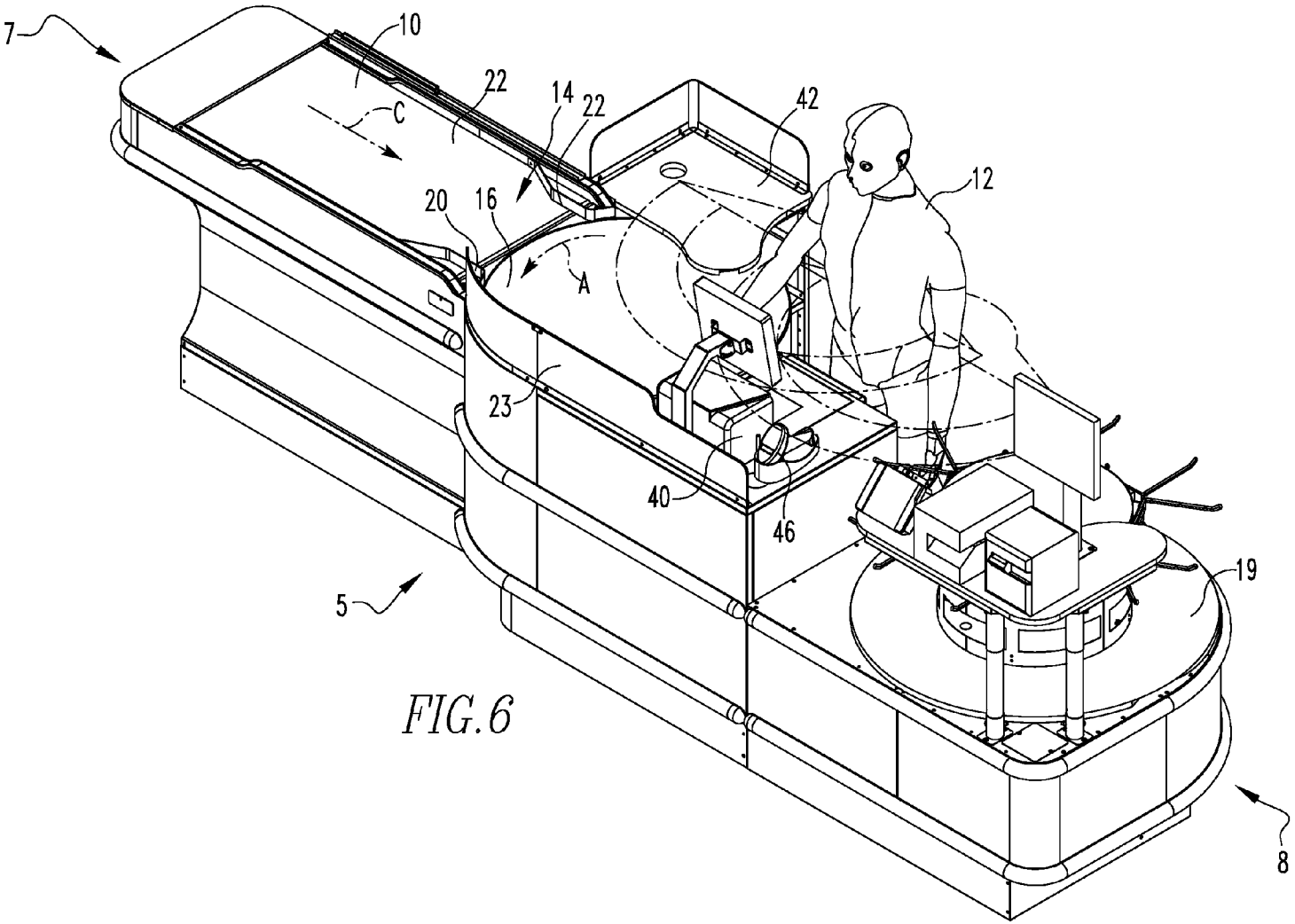
FIG. 6 shows an isometric view of the front of the checkstand of FIG. 1.
Figure 7:
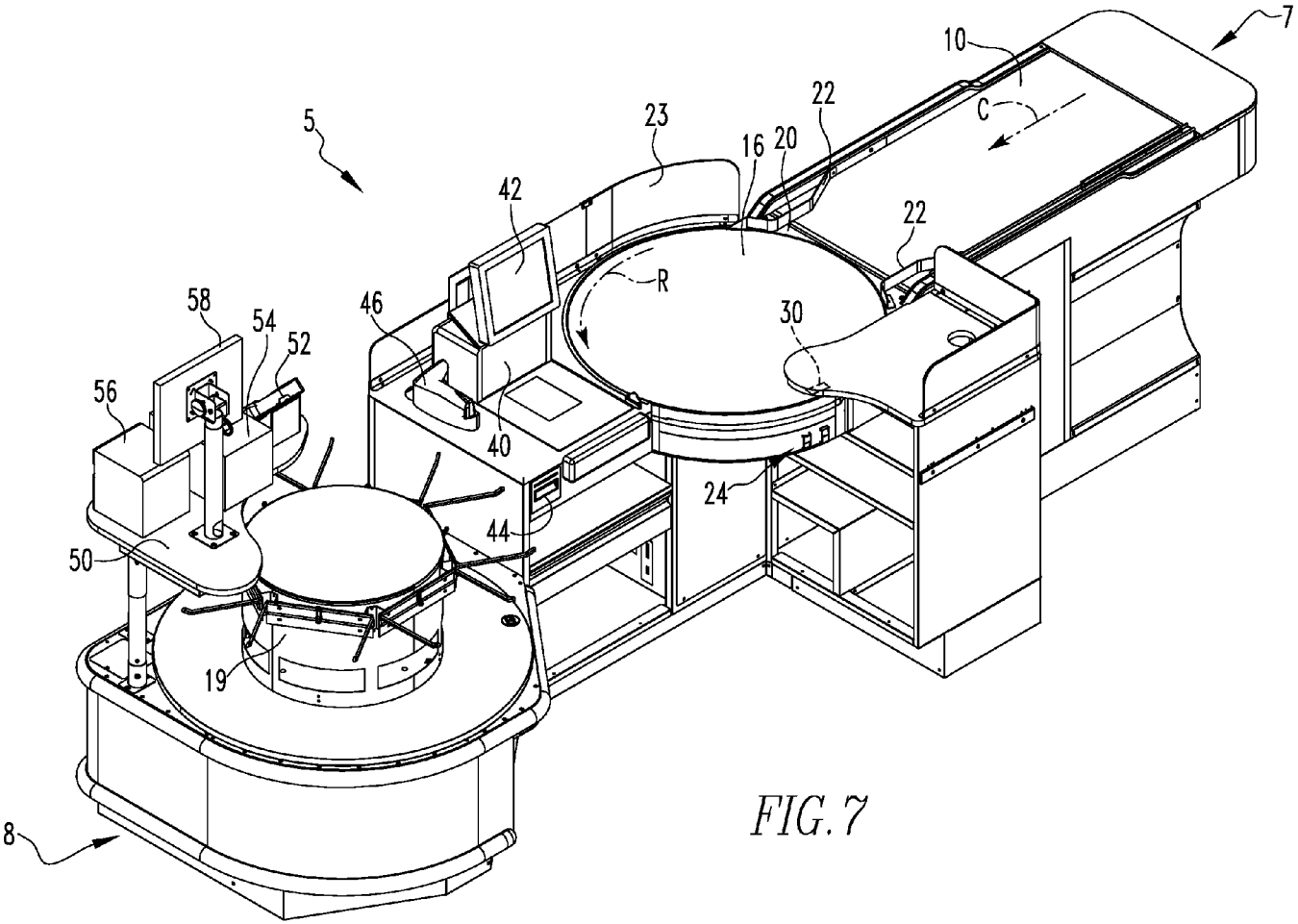
FIG. 7 shows another isometric view of the rear of the checkstand of FIG. 1.
Figure 8:
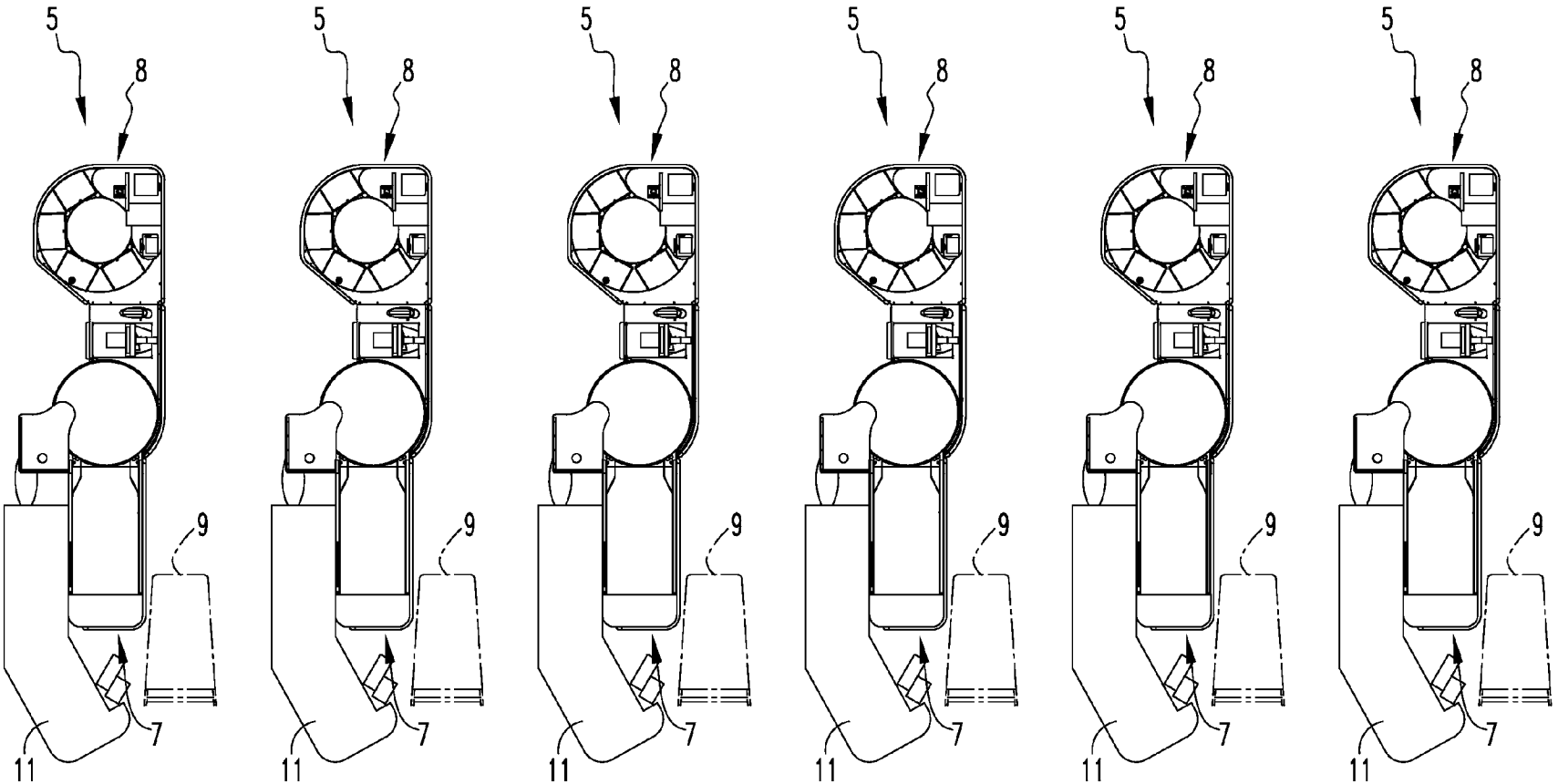
FIG. 8 shows a plan view of a plurality of checkstands and retail display unites such as shown in FIG. 1 disposed in a layout in accordance with an embodiment of the invention.

Referring to FIGS. 2, 5 and 6, to aid in the maneuvering of items (not shown) such as, for example, without limitation, groceries, checkstand 5 is provided with an electrically actuated conveyor mechanism, shown in the form of a conveyor belt 10, hereinafter referred to as "conveyor". Conveyor 10 is disposed to move items generally from the first end 7 of checkstand 5 toward a cashier 12 positioned generally near a second end 14 of conveyor 10, in a direction shown by arrow C, when actuated. Similar to conveyor mechanisms used on conventional checkstands, conveyor 10 is preferably formed from a sheet of reinforced rubber or rubberized material formed into a belt and disposed about a plurality of rollers (not shown) that are selectively rotated by an electric motor (not shown). Although not shown in the FIGS., it is to be appreciated that such related components are generally disposed within cabinet 6 (FIG. 1), similar to conventional conveyor mechanisms.

Continuing to refer to FIGS. 2, 5 and 6, checkstand 5 further includes an electrically actuated rotatable surface, such as turntable mechanism 16, hereinafter referred to as "turntable", disposed proximate the second end 14 of the conveyor 10. Turntable 16 is mechanically coupled to an electric motor (not shown) or other suitable device disposed within cabinet member 6 such that the turntable 16 rotates generally about an axis 18 (FIGS. 2 and 5) disposed generally perpendicular to the top surface (not numbered) of the turntable 16 when actuated. In the example embodiment depicted, turntable 16 rotates in a counterclockwise direction when viewed from above, as shown by the arrow R in the overhead view of FIG. 2 (as well as the perspective views of FIGS. 5 and 6). When used in checking operations, conveyor 10 transports items to, and deposits items on, turntable 16, from which cashier 12 may readily select items for bagging. Preferably, turntable 16 is formed from a synthetic or other suitable material having a generally low coefficient of friction that provides for items to both move along with the rotating surface as well as slip with respect to such surface so as to not bind or jam against the rotating surface.

As shown in the overhead view of FIG. 2, a large portion of turntable 16 is preferably disposed within ready reach of cashier 12 (as shown by arcs 17*a* and 17*b* in FIG. 2) such that cashier 12 does not have to overly extend to reach an item disposed on turntable 16. The generally large surface area provided on turntable 16 allows for a cashier 12 to selectively choose items for bagging into one or more shopping bags (not shown) provided on a rotatable bagging carousel 19, as discussed further below. In order to maximize bagging efficiency, items are preferably selected from turntable 16 according to a predetermined criteria. For example, without limitation, such predetermined criteria may comprise selecting all meat products or cleaning products for bagging together in common bags (i.e., meat in one bag, cleaning products in another bag). Alternatively, the disclosed combination of turntable 16 and rotatable bagging carousel 19 allows for items from different groupings to be selected and readily placed in separate bags to form bags grouped according to predetermined criteria. In such instance, items for each different predetermined group are placed in separate bags, each bag being easily reached by the cashier 12 through rotation of the bagging carousel 19. In instances where movement of the bagging carousel 19 is not desired, a lock mechanism, such as a locking pin (not shown) may be engaged to prevent rotation of the bagging carousel 19.

To assist in the transfer of items from conveyor 10 to turntable 16, a transition member 20 is positioned between the second end 14 of conveyor 10 and turntable 16. Preferably, the transition member 20 is formed from a material having a very low coefficient of friction (e.g., without limitation, stainless steel, aluminum) such that items may readily slide over the top surface of transition member in passing from the conveyor 10 to the turntable 16. In addition to transition member 20, a pair of guide members 22 are preferably positioned on either side of second end 14 of conveyor 10 to likewise assist in the transition of items from the conveyor 10 to the turntable 16. As shown in FIG. 2, each of the guide members 22 are generally formed to extend inward from outer edges (not numbered) of conveyor 10 in a manner that shifts items moving on conveyor 10 away from such outer edges prior to reaching transition member 20. Similar to transition member 20, guide members 22 are preferably formed from a material having a very low coefficient of friction (e.g., without limitation, stainless steel, aluminum) such that items may readily slide along, and be shifted by, the guide members while moving on conveyor 10 and subsequently passing to turntable 16.

As perhaps best shown in FIGS. 5 and 6, a guard member 23, preferably formed from a rigid, generally transparent material (e.g., without limitation, Lexan®), is provided on cabinet 6 along a portion of turntable 16. Guard member 23 serves to ensure that items moving from conveyor 10 to turntable 16 are not accidentally knocked off checkstand 5 by the cashier 12 or customer (not shown) while still providing for viewing of items on turntable 16 by a customer.

A number of switches 24 (FIG. 3) that may be used to control one or more of the conveyor 10 and turntable 16 are preferably provided on or in cabinet member 6 within ready reach of cashier 12. It is to be appreciated that conveyor 10 and turntable 16 are capable of being independently operated. In a preferred embodiment, the number of switches 24 includes a switch structured to activate conveyor 10 and a switch structured to activate turntable 16.

In addition to manual controls provided by switches 24, a number of sensors suitable for detecting the presence, or lack thereof, of items on one or both of the conveyor 10 and turntable 16 may be provided along all or selected portions of one or both of conveyor 10 and turntable 16 to provide automatic or partially automatic control of conveyor 10 and turntable 16 in addition to the manual controls provided by the number of switches 24. Such sensors may be employed to cause one or both of conveyor 10 and turntable 16 to selectively operate.

As a non-limiting example, as shown in FIG. 2, a visual sensor 30 (shown schematically in hidden line) may be disposed near the edge 32 of turntable 16 near the cashier 12 in order to detect the presence of one or more items nearing edge 32. Upon detecting the presence of items at or near edge 32, such sensor causes turntable 16 to stop rotating, thus helping to prevent items from falling from turntable 16, such as could potentially occur if cashier 12 is occupied elsewhere or distracted. In such instance where the turntable 16 would be stopped, conveyor 10 would likewise typically also be stopped in order to avoid a piling up of items at the second end 14 of the conveyor 10 and turntable 16. In such instance, one or both of the conveyor 10 and turntable 16 could then be restarted through activation of one or more of switches 24 by cashier 12.

As another non-limiting example, a sensor (not shown) could be placed to monitor the edge (not numbered) of turntable 16 near the second end 14 of conveyor 10. Such sensor would be used to detect the presence of items moving from conveyor 10 to turntable 16 and thus cause turntable 16 to be actuated as items from conveyor 10 pass to turntable 16.

As yet another non-limiting example, one or more sensors 26 may be employed in conjunction with the conveyor 10 to cause the conveyor 10 to stop as a result of no items being present on the conveyor 10 (thus no items needing to be moved) or alternatively to start upon detection of items on conveyor 10. In one or both cases, operation of the turntable may also be coupled or partially coupled to such sensors. For example, once items are detected on the conveyor 10, conveyor 10 and turntable 16 may automatically be switched to a moving operation from a standby, non-moving state. Subsequently, upon detecting no items on conveyor 10, conveyor 10 may be automatically switched off. At such time turntable 16 may likewise be switched off or allowed to operate for a predetermined period of time or until switched off either manually by a cashier 12 or through other automatic means such as previously described.

As a further non-limiting example, one or more sensors 34 (shown schematically in hidden line in FIG. 2) may be used to detect the presence of an order separator member 36 (FIG. 2) disposed on conveyor 10. In conventional checkstands, an order separator bar or divider is commonly used to separate items from one customer to a next. Such separators typically are formed from plastic or other lightweight material that a customer or cashier can simply place on the conveyor to signify the end of a first customer's items and thus separate them from the start of a second customer's items. The presence of such conventional separator is detected solely by a cashier checking items. In contrast, separator member 36 preferably includes one or more pieces of magnetic material (not shown) or other suitable detectable material disposed along separator member 36 which can then be detected by sensor(s) 34 disposed preferably under conveyor 10, near second end 14. To account for instances where separator member 36 is disposed at an angle other than perpendicular to the direction of movement C of conveyor 10, separator member 36 preferably includes suitable detectable material disposed at or about each end. In operation separating a first customer's items from a second customer's items, a first customer's items would pass along conveyor 10 and onto turntable 16, as previously discussed. As the last of the first customer's items pass from conveyor 10, separator member 36 (which is disposed on conveyor 10 between the last of first customer's items and the start of second customer's items) would approach second end 14 of conveyor 10, and thus sensor(s) 34. Upon detecting the presence of separator member 36, sensor(s) 34 cease actuation of conveyor 10 (while not affecting actuation of turntable 16), thus keeping the second customer's items from getting mixed on turntable 16 with the first customer's items. Although shown generally in certain example positions in the embodiments disclosed herein, it is to be appreciated that sensors described herein, as well as additional sensors not particularly described may be employed without varying from the scope of the present invention.

Figure 3:
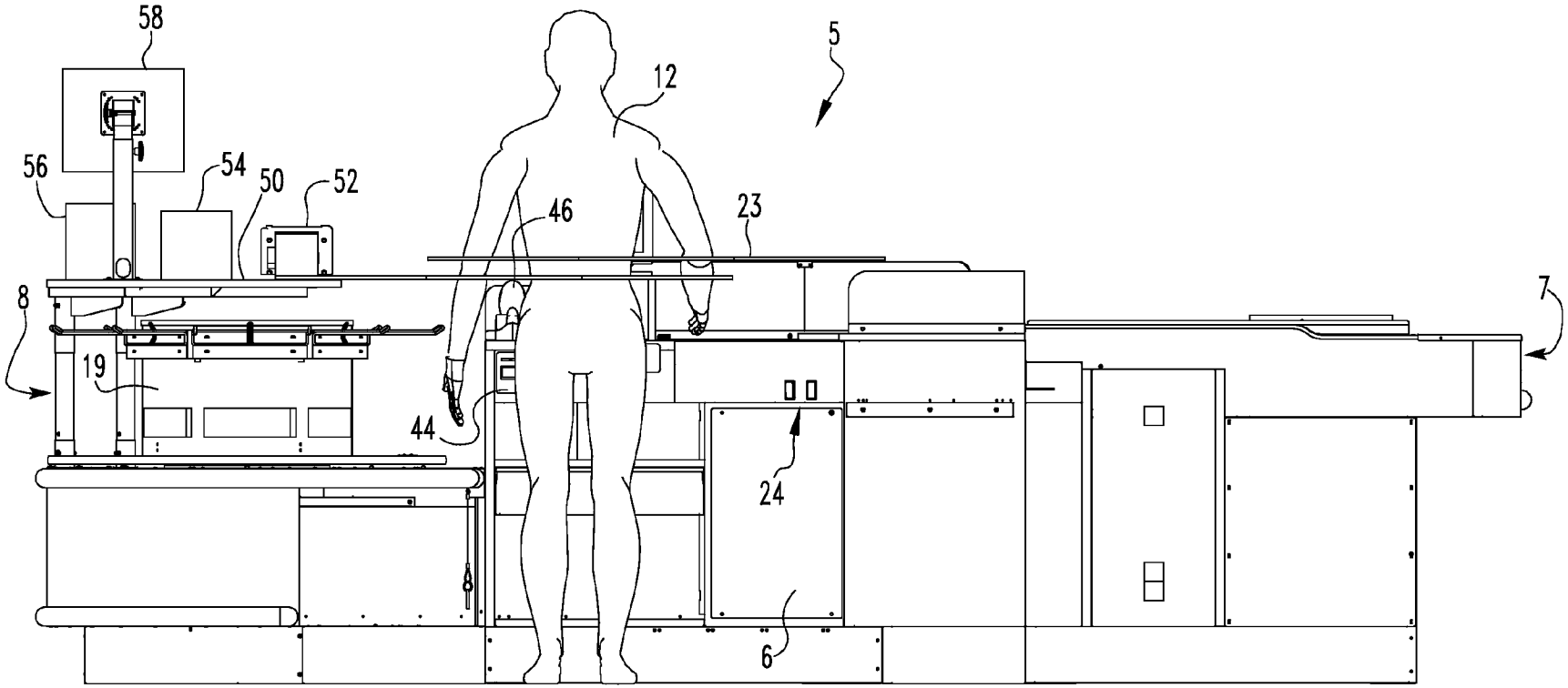
FIG. 3 shows a rear elevational view of the checkstand of FIG. 1.

Checkstand 5 further includes a scanner/scale machine 40 for scanning/weighing of items being checked out by the cashier 12. Machine 40 preferably includes a monitor 42 and a cash drawer 44 (FIG. 3). A handheld scanner 46 is preferably provided near machine 40. An elevated portion or platform 50 is preferably provided near bagging carousel 19. Elevated portion 50 preferably includes customer related devices, such as an electronic funds transfer (EFT) pinpad 52, a POS printer 54, a catalina printer 56 and a customer monitor 58.

Figure 4:
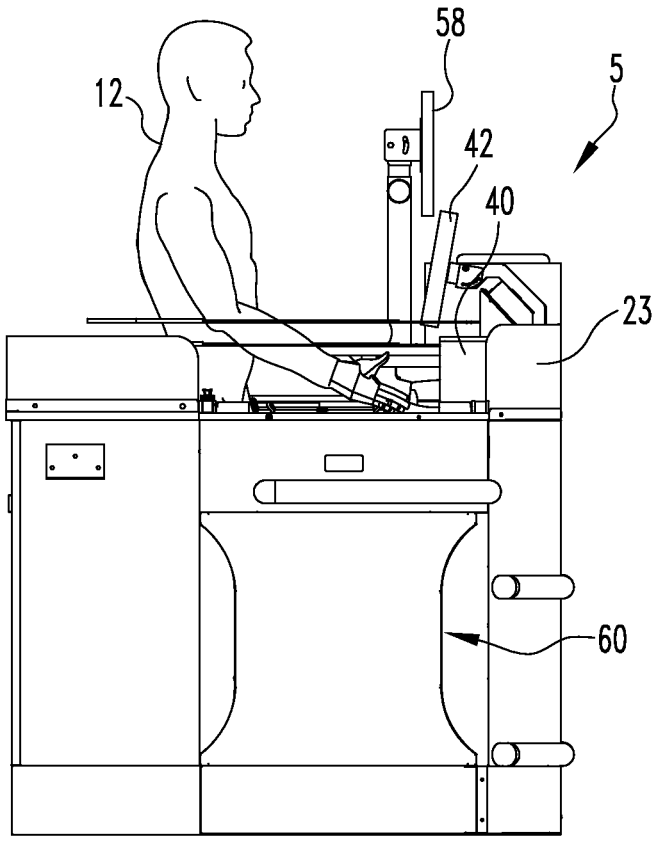
FIG. 4 shows an end elevational view of the checkstand of FIG. 1.

As perhaps best shown in FIG. 4, to aid in the unloading of items from a cart 9 (FIG. 1), checkstand 5 is preferably provided with a generally concave side profile 60 at or about the length of conveyor 10. Such concave profile 60 particularly provides for additional room for unloading items from lower areas of cart 9, especially when multiple checkstands 5 are arranged such as those shown in FIG. 7.

Other features, in addition to those elements particularly described herein, may be found in the example figures provided herewith.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

What is claimed is:

1. A checkstand for checking a customer from a retail establishment, the checkstand comprising:

a cabinet having a first end and an opposite second end;

an electrically actuated conveyor mounted on a portion of the cabinet proximate the first end, the conveyor being structured to convey items placed directly thereon by the customer from a first end to an opposite second end thereof when actuated;

an electrically actuated rotatable turntable mounted on the cabinet proximate the second end of the conveyor, the turntable being structured to receive items from the conveyor and a cashier interface disposed adjacent the turntable generally opposite the second end of the conveyor.

2. The checkstand of claim 1 wherein the cabinet comprises a number of sensors disposed therein, at least one of the number of sensors being structured to detect the presence of one or more items on the conveyor and, in response thereto, actuate the conveyor.

3. The checkstand of claim 1 wherein the cabinet comprises a number of sensors disposed therein, at least one of the number of sensors being structured to detect the presence of one or more items at a particular location on the turntable and, in response thereto, cause the turntable to either begin to rotate or to cease rotating.

4. The checkstand of claim 1 wherein the cabinet comprises a number of sensors disposed therein, at least one of the number of sensors being structured to detect the presence of a separator member on the conveyor proximate the second end of the conveyor and, responsive thereto, cease actuation of the conveyor.

5. The checkstand of claim 4 wherein the separator member comprises a magnetic material and wherein the at least one of the number of sensors comprises a magnetic sensor.

6. A method of operating a checkstand, the method comprising;

receiving a first number of items placed directly on a conveyor by a first customer;

transporting the first number of items along the conveyor;

transferring the first number of items from the conveyor to a rotating surface;

selecting an item from among the first number of items on the rotating surface; and scanning the selected item to determine a price.

7. The method of claim 6 further comprising placing the selected item in a shopping bag after scanning the selected item.

8. The method of claim 7 wherein the selected item is chosen according to a predetermined criteria.

9. The method of claim 6 further comprising receiving a second number items from a second customer on the conveyor while selectively choosing items from the first number of items from the rotatable surface.

10. The method of claim 9 further comprising:

providing a separator member for placement on the conveyor between the first number of items and the second number of items;

transporting at least a portion of the first number of items and the second number of items along the conveyor;

sensing the position of the separator member at a location on the conveyor near the rotatable surface; and stopping movement of the conveyor in response to sensing the position of the separator member.

11. The checkstand of claim 1 wherein the electrically actuated conveyor is mounted proximate a portion of the cabinet structured to receive a cart from the customer.

12. The checkstand of claim 11 wherein the portion of the cabinet comprises a side panel having a concave profile.

13. The checkstand of claim 1 wherein the cashier interface comprises a scanning machine.

14. A checkstand for checking a customer from a retail establishment, the checkstand comprising:

a cabinet having a first end and an opposite second end;

an electrically actuated conveyor mounted on a portion of the cabinet proximate the first end and positioned to receive items placed directly thereon by the customer, the conveyor being structured to convey items from a first end to an opposite second end thereof when actuated; and an electrically actuated rotatable turntable mounted on the cabinet proximate the second end of the conveyor, the turntable being structured to receive items from the conveyor, wherein the conveyor is mounted proximate a portion of the cabinet structured to receive a cart from the customer, and wherein the portion of the cabinet structured to receive a cart from the customer comprises a side panel having a concave profile.

* * * * *

UNITED STATES PATENT AND TRADEMARK OFFICE

CERTIFICATE OF CORRECTION

PATENT NO. : 8,485,346 B2
APPLICATION NO. : 13/008450
DATED : July 16, 2013
INVENTOR(S) : Dave Redick et al.

It is certified that error appears in the above-identified patent and that said Letters Patent is hereby corrected as shown below:

In the Specification
Column 1, line 42, "each item." should read --barcodes on items which are then looked up in a database containing pricing info for each item.--.

In the Claims
Column 8, Claim 1, line 7, "veyor and" should read --veyor; and--.
Column 8, Claim 6, line 31, "prising;" should read --prising:--.

Signed and Sealed this
Thirty-first Day of December, 2013

Margaret A. Focarino

Margaret A. Focarino
*Commissioner for Patents of the United States Patent and Trademark Office*